US008490671B1

(12) United States Patent
Spencer

(10) Patent No.: US 8,490,671 B1
(45) Date of Patent: Jul. 23, 2013

(54) SCREENED AREA WATER PASSAGEWAY

(76) Inventor: Wayne Spencer, Tampa, FL (US)

( * ) Notice: Subject to any disclaimer, the term of this patent is extended or adjusted under 35 U.S.C. 154(b) by 80 days.

(21) Appl. No.: 13/065,968

(22) Filed: Apr. 4, 2011

Related U.S. Application Data

(63) Continuation-in-part of application No. 12/930,765, filed on Jan. 18, 2011.

(51) Int. Cl.
*E06B 7/28* (2006.01)

(52) U.S. Cl.
USPC ..... 160/180; 160/44

(58) Field of Classification Search
USPC ..... 160/180, 44; 52/169.5; 49/170, 171
See application file for complete search history.

(56) References Cited

U.S. PATENT DOCUMENTS

| | | | | | |
|---|---|---|---|---|---|
| 3,985,174 | A | * | 10/1976 | Bricker | 160/180 |
| 4,603,724 | A | * | 8/1986 | Borwick | 160/180 |
| D335,002 | S | * | 4/1993 | Read et al. | D30/108 |
| 5,701,813 | A | * | 12/1997 | Smith | 160/180 |
| 6,129,130 | A | * | 10/2000 | Rekret | 160/40 |
| 6,506,112 | B1 | * | 1/2003 | Halbleib et al. | 454/225 |

* cited by examiner

*Primary Examiner* — Blair M. Johnson
(74) *Attorney, Agent, or Firm* — Edward P Dutkiewicz

(57) ABSTRACT

A screened area water passageway comprising a passageway frame, with the passageway frame having an open bottom. There is included a long side mounting strip coupled to the passageway frame. There is also a passageway door frame coupled to the passageway frame.

5 Claims, 3 Drawing Sheets

FIG. 1
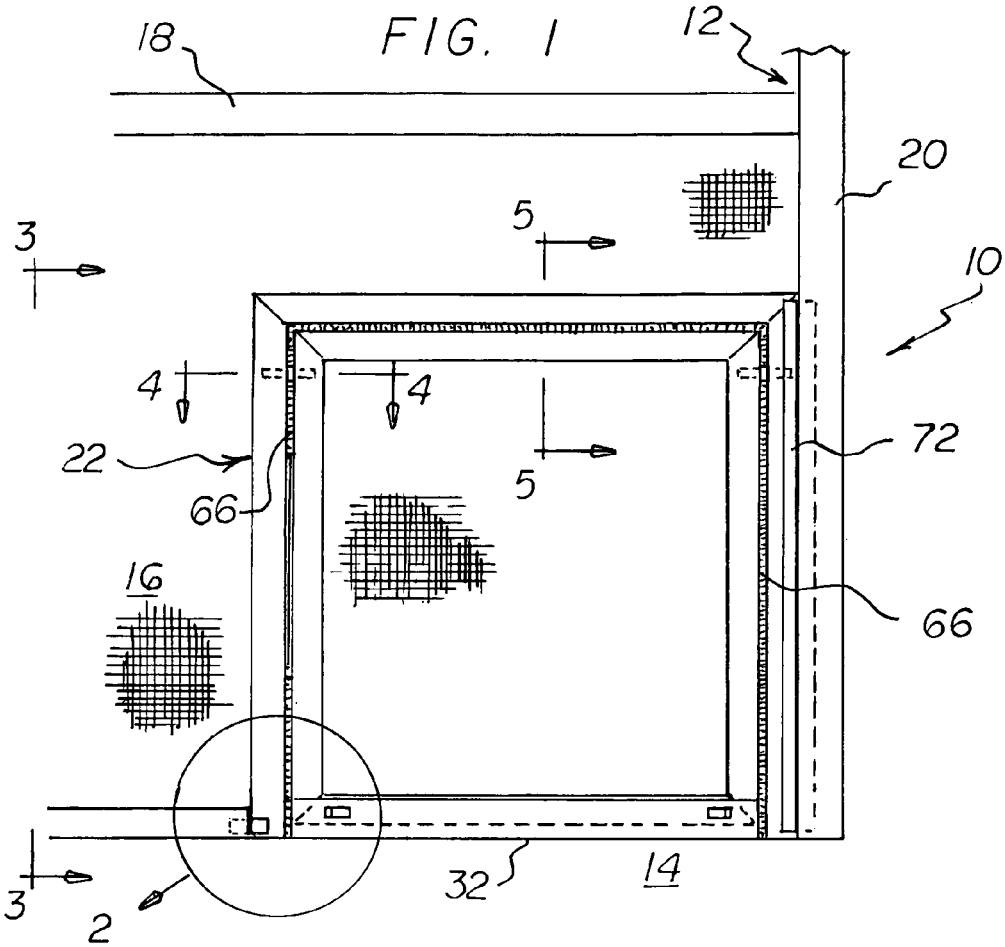
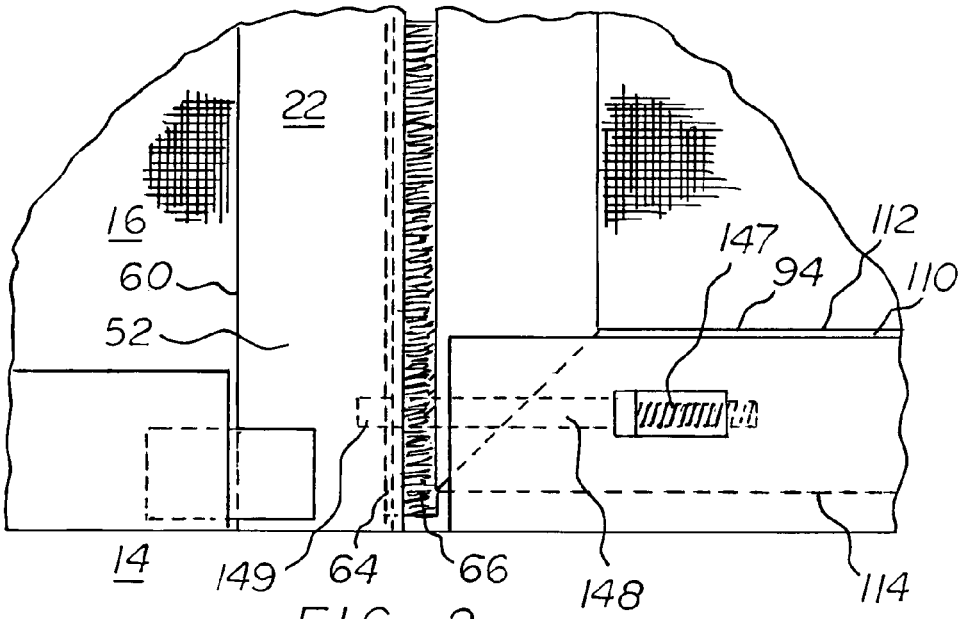
FIG. 2

FIG. 6
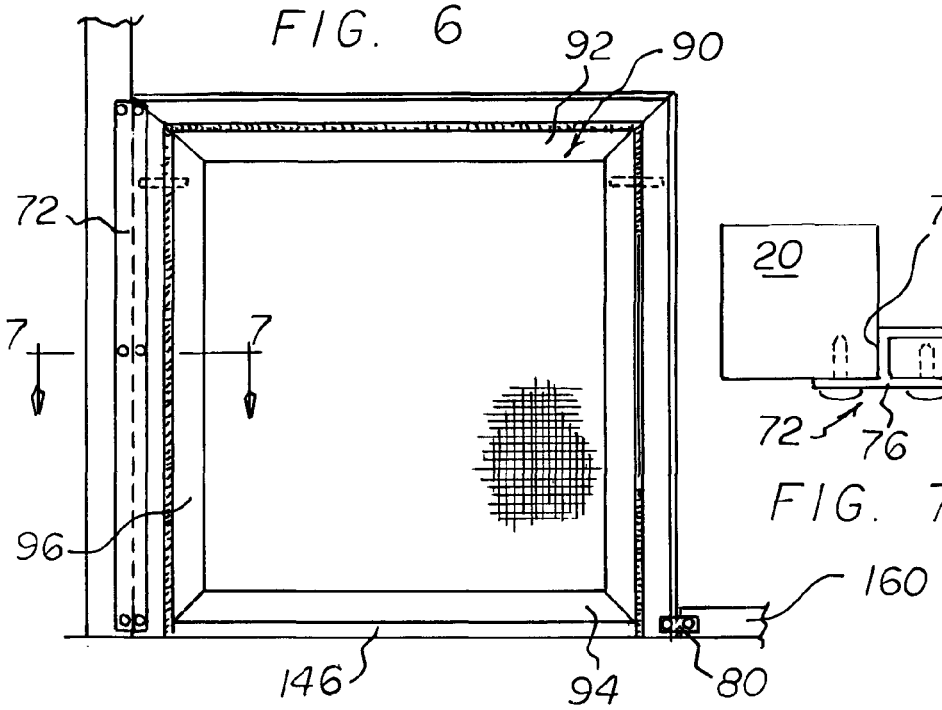
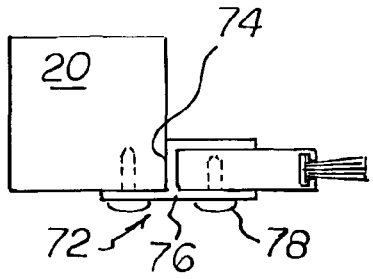
FIG. 7
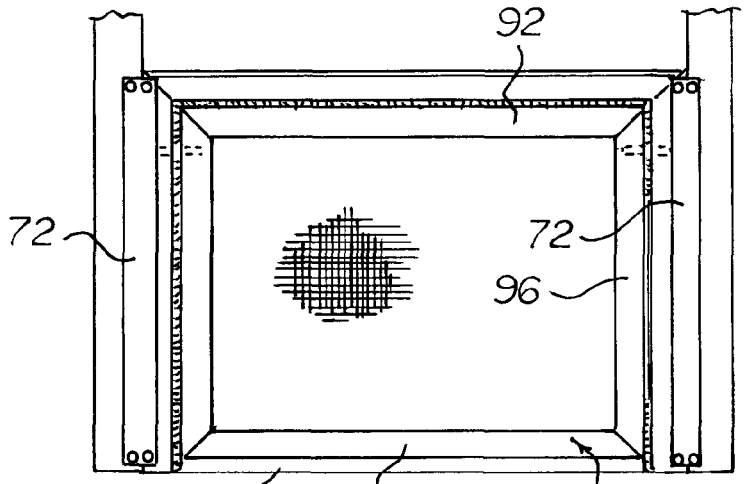
FIG. 8
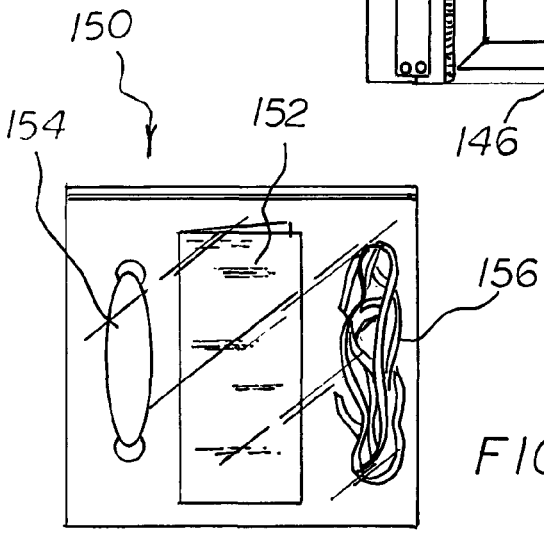
FIG. 9

SCREENED AREA WATER PASSAGEWAY

RELATED APPLICATIONS

This application is a continuation-in-part of a presently pending patent application, bearing Ser. No. 12/930,765 and filed on Jan. 18, 2011, priority of which is herein claimed.

BACKGROUND OF THE INVENTION

1. Rule 1.78(F)(1) Disclosure

The Applicant has submitted a related pending or patented non-provisional application within two months of the filing date of this present application. The invention is made by a single inventor, so there are no other inventors to be disclosed. This application is not under assignment to any other person or entity at this time. The priority of the related application is claimed below.

2. Field of the Invention

The present invention relates to a screened area water passageway and more particularly pertains to a device for allowing water out of a screened enclosure.

3. Description of the Prior Art

The use of devices for allowing water from a screened enclosure is known in the prior art. More specifically, devices for allowing water from a screened enclosure previously devised and utilized for the purpose of removing water from within the screened enclosure are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe screened area water passageway that allows a device for allowing water out of a screened enclosure.

In this respect, the screened area water passageway according to the present invention substantially departs from the conventional concepts and designs of the prior art, and in doing so provides an apparatus primarily developed for the purpose of allowing a user to direct water out of a screened enclosure.

Therefore, it can be appreciated that there exists a continuing need for a new and improved screened area water passageway which can be used for a device for allowing water out of a screened enclosure. In this regard, the present invention substantially fulfills this need.

SUMMARY OF THE INVENTION

In view of the foregoing disadvantages inherent in the known types of devices for allowing water from a screened enclosure now present in the prior art, the present invention provides an improved screened area water passageway. As such, the general purpose of the present invention, which will be described subsequently in greater detail, is to provide a new and improved screened area water passageway which has all the advantages of the prior art and none of the disadvantages.

To attain this, the present invention essentially comprises a screened area water passageway comprising several components, in combination. The water passageway is coupled to a screen structure which is attached to a deck surface.

There is a screen structure which has a screen fastened thereto. The screen structure has at least one member.

The passageway frame is fabricated of a rigid material. The passageway frame has a front surface, a back surface, a top member, and a pair of generally parallel side members. The frame has an open bottom. The top member has a generally rectilinear configuration with a flat front surface, a flat top surface, and a generally flat back surface. The back surface has a screen seal receiving groove therein. The receiving groove has a lip for retaining a screen seal.

The frame top member has a lower surface with a brush groove therein. The brush groove is configured to mate with and receive a top brush seal. The top brush seal has downwardly oriented bristles.

Each of the passageway frame side members has a generally rectilinear configuration with a flat front surface and a flat back surface, with the back surface having a screen seal receiving groove therein. The screen seal receiving groove has a lip for retaining a screen seal. Each side member has a generally flat outer surface. Each side member has a generally flat inner surface, with the inner surface having a side brush groove therein. The side brush groove is configured to mate with and receive a side brush seal. Each side brush seal has inwardly oriented bristles. Each side member inner surface having a pivot pin hole therein. Each side member has an associated pivot pin.

There is a side mounting strip which is fabricated of rigid material and has a first length. The side mounting strip has a generally h-shaped configuration. The side mounting strip has a stepped back surface and a flat front surface. The stepped back surface is configured to accept and mate with a structure member. The side mounting strip has at least one fastener associated there with.

There is a short side mounting strip which is fabricated of rigid material and has a second length. The short side mounting strip has a generally h-shaped configuration. The side mounting strip has a stepped back surface and a flat front surface. The stepped back surface is configured to accept and mate with a structure member. The side mounting strip has at least one fastener associated there with. The second strip length is less than the first strip length.

There is a passageway door frame which is fabricated of a rigid material and has a generally rectilinear configuration. The passageway door frame has a top member, a bottom member, and a pair of generally parallel like-configured side members. The top member and the bottom member are oriented to be generally parallel. The top member and bottom member each have a like-configuration, and are mirror images of each other.

The door frame top member has a generally rectilinear configuration with a generally flat front surface, a generally flat upper surface, a generally flat lower surface, and a generally flat back surface. The back surface has a screen seal receiving groove therein. The receiving groove has a lip for retaining a screen seal.

The door frame bottom member has a generally rectilinear configuration with a generally flat front surface, a generally flat upper surface, a generally flat lower surface, and a generally flat back surface. The back surface has a screen seal receiving groove therein. The receiving groove has a lip for retaining a screen seal.

Each side member has a generally rectilinear configuration with a generally flat front surface and a generally flat back surface. Each side member back surface has a screen seal receiving groove therein. The receiving groove has a lip for retaining a screen seal.

There is a flexible seal strip which has a generally rectilinear configuration. The flexible seal strip is attached to the front surface of the bottom member.

Lastly, there is a locking latch for keeping the door frame in an open orientation. The locking latch has a first end and a second end. There is a fastening hole located on the first end of the locking latch. The locking latch has a generally rectilinear configuration with a notched slot therein. The notched slot has an associated pin hole. The locking latch has an associated fastener and an associated pin.

The locking latch is coupled to the passageway frame and passageway door frame. The locking latch has a generally rectilinear configuration with a notched slot. The locking latch has an associated pin and an associated fastener. The pin forms a fastener affixes a first end of the locking latch and the pin is attached to the door frame and provides a point of engagement for the notched slot, allowing the door to be kept open to varying degrees.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved screened area water passageway which has all of the advantages of the prior art devices for allowing water from a screened enclosure and none of the disadvantages.

It is another object of the present invention to provide a new and improved screened area water passageway which may be easily and efficiently manufactured and marketed.

It is further object of the present invention to provide a new and improved screened area water passageway which is of durable and reliable constructions.

An even further object of the present invention is to provide a new and improved screened area water passageway which is susceptible of a low cost of manufacture with regard to both materials and labor, and which accordingly is then susceptible of low prices of sale to the consuming public, thereby making such screened area water passageway economically available to the buying public.

Even still another object of the present invention is to provide a screened area water passageway for allowing water out of a screened enclosure.

Lastly, it is an object of the present invention to provide a new and improved screened area water passageway comprising a passageway frame, with the passageway frame having an open bottom. There is included a long side mounting strip coupled to the passageway frame. There is also a passageway door frame coupled to the passageway frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is front elevational view of the water passageway, in place in a structure screen, and atop a patio deck.

FIG. 2 is a close up of circle 2 of FIG. 1, showing the showing the spring biased bolt for locking the passageway in the closed orientation.

FIG. 6 is a view taken along line 6-6 of FIG. 3.

FIG. 7 is a view taken along line 7-7 of FIG. 6, showing the cross sectional view of the structure member, long strip, and side member of the passageway frame, with brush seal.

FIG. 8 is a front elevational view of a variation of the preferred embodiment, where two long strips are used to mount the passageway frame to two structure supports.

FIG. 9 is a top view of the kit, containing the instructions, screen seal installment too, and a length of screen seal.

The same reference numerals refer to the same parts throughout the various Figures.

DESCRIPTION OF THE PREFERRED EMBODIMENT

Figure 3:
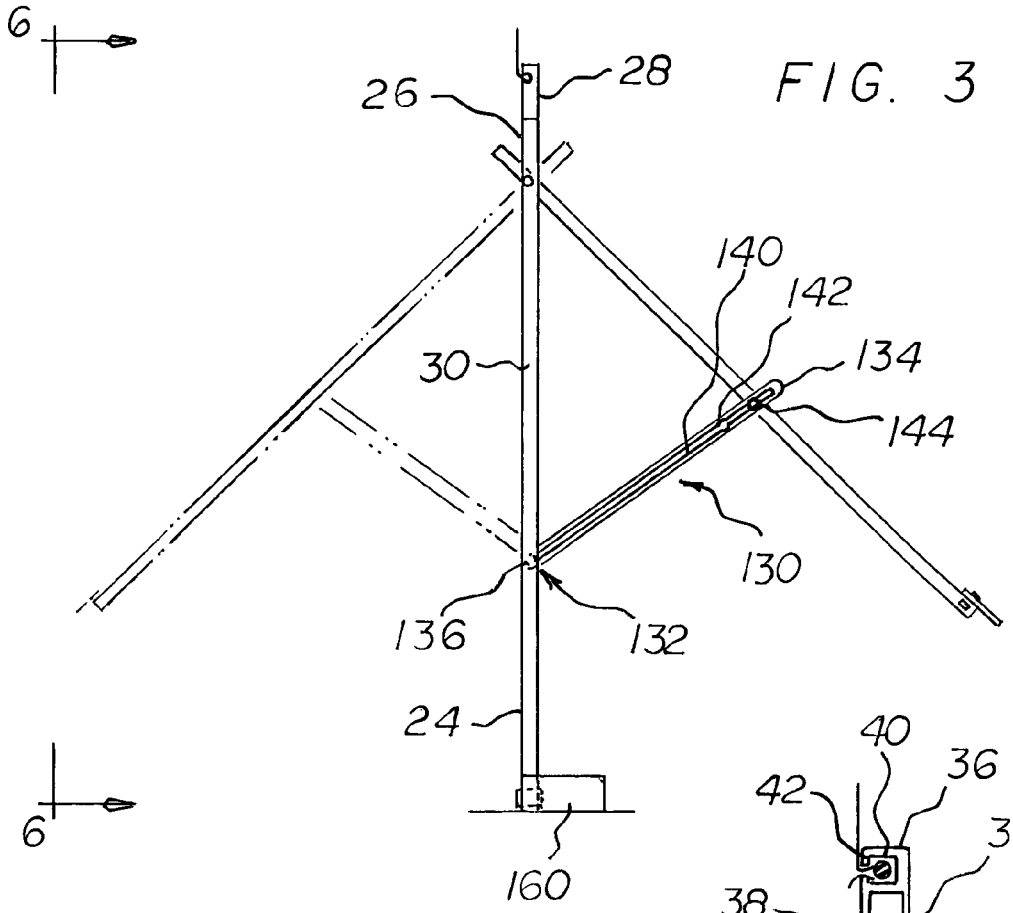
FIG. 3 is a view taken along line 3-3 of FIG. 1, wherein the door frame is in the opened position and held in position by the locking latch. Note that the number of notches in the slot allow for various door frame hold-open positions.
Figure 4:
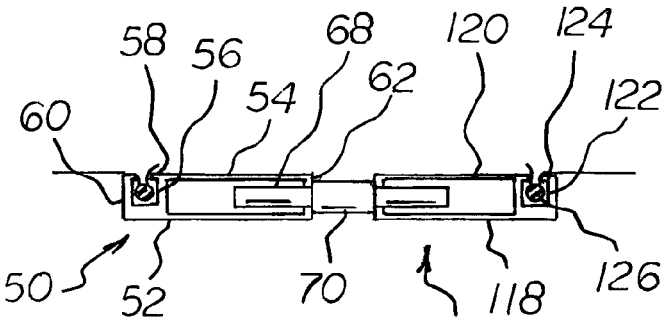
FIG. 4 is a view taken along line 4-4 of FIG. 1, showing the location of the pivot pin and cross section of the passageway frame and door frame.
Figure 5:
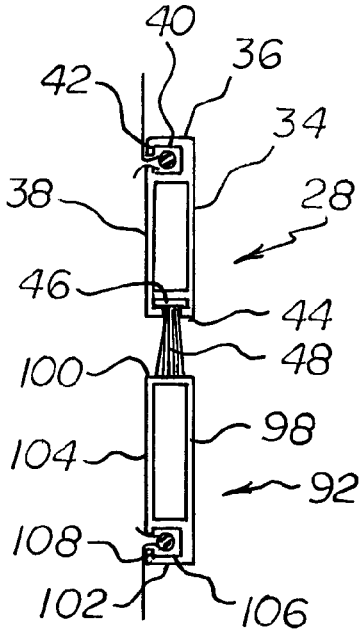
FIG. 5 ids a view taken long line 5-5 of FIG. 1, showing the receiver groove and seal, the brush seal groove and seal as well as the surface configuration of the passageway frame and door frame.

With reference now to the drawings, and in particular to FIG. 1 thereof, the preferred embodiment of the new and improved screened area water passageway embodying the principles and concepts of the present invention and generally designated by the reference numeral 10 will be described.

The present invention, the screened area water passageway 10 is comprised of a plurality of components. Such components in their broadest context include a passageway frame, a passageway door frame, a long strip and a seal. Such components are individually configured and correlated with respect to each other so as to attain the desired objective.

A screened area water passageway 10 comprising several components, in combination. The water passageway is coupled to a screen structure 12 which is attached to a deck surface 14. Such a deck surface is commonly found around pools and patios.

There is a screen structure which has a screen 16 fastened thereto. The screen structure has at least one member. Such screened enclosures are referred to as "bird cages" which surround and cover pool and patio areas. Generally the structures have multiple members, some vertical 18 and some horizontal 20 which form the framework structure for attaching a screen material thereto, thereby preventing insects from entering the pool or patio area.

The disclosed device has a passageway frame, which is attached to the screen and the structure, the installation of which will be discussed below.

The passageway frame 22 is fabricated of a rigid material. The passageway frame has a front surface 24, a back surface 26, a top member 28, and a pair of generally parallel side members 30. The frame has an open bottom 32.

The top member has a generally rectilinear configuration with a flat front surface 34, a flat top surface 36, and a generally flat back surface 38. The back surface has a screen seal receiving groove 40 therein. The receiving groove has a lip 42 for retaining a screen seal.

In other variations, the surfaces of the frame may be curved, round, or trapezoidal.

The passageway frame top member has a lower surface 44 with a brush groove 46 therein. The brush groove is configured to mate with and receive a top brush seal 48. The top brush seal has downwardly oriented bristles. Brush seals are will known in the art, forming a seal by the projection of multiple bristles into the space between two components. The bristles provide a flexible seal, and a barrier to keep out unwanted insects.

Each of the passageway frame side members 50 has a generally rectilinear configuration with a flat front surface 52 and a flat back surface 54, with the back surface having a screen seal receiving groove 56 therein. The screen seal receiving groove has a lip 58 for retaining a screen seal.

Each side member has a generally flat outer surface 60. Each side member has a generally flat inner surface 62, with the inner surface having a side brush groove 64 therein. The side brush groove is configured to mate with and receive a side brush seal 66. Each side brush seal has inwardly oriented bristles. Each side member inner surface having a pivot pin hole 68 therein. Each side member has an associated pivot pin 70.

The pivot pins are located toward the upper end of the side passageway frame member. The pivot pins allow for the horizontal oriented swing of door frame, described below.

There is a side mounting strip 72 which is fabricated of rigid material and has a first length. The side mounting strip has a generally h-shaped configuration. The side mounting strip has a stepped back surface 74 and a flat front surface 76. The stepped back surface is configured to accept and mate with a structure member. The side mounting strip has at least one fastener 78 associated there with.

There is a short side mounting strip 80 which is fabricated of rigid material and has a second length. The short side mounting strip has a generally h-shaped configuration. The side mounting strip has a stepped back surface and a flat front surface and is configured similarly to the long mounting strip, but shorter in length. The stepped back surface of the short mounting strip is configured to accept and mate with a structure member. The side mounting strip has at least one fastener associated there with. The second strip length is less than the first strip length.

In one variation only the long side mounting strip is used to attach the device to the structure. In other variations, where the dimensions of the device fill a structure between structure members, such as vertical members, then two long mounting strips may be used, as shown in FIG. 8.

In another variation, but not shown, a mounting strip may be attached to the tip member of the passageway frame, fixing the top member to a structure horizontal member.

In the preferred embodiment there is used a long mounting strip and a short mounting strip, as shown in FIG. 6.

There is a passageway door frame 90 which is fabricated of a rigid material and has a generally rectilinear configuration. The passageway door frame has a top member 92, a bottom member 94, and a pair of generally parallel like-configured side members 96. The top member and the bottom member are oriented to be generally parallel. The top member and bottom member each have a like-configuration, and are mirror images of each other.

The door frame top member has a generally rectilinear configuration with a generally flat front surface 98, a generally flat upper surface 100, a generally flat lower surface 102, and a generally flat back surface 104. The back surface has a screen seal receiving groove 106 therein. The receiving groove has a lip 108 for retaining a screen seal.

The door frame bottom member has a generally rectilinear configuration with a generally flat front surface 110, a generally flat upper surface 112, a generally flat lower surface 114, and a generally flat back surface 116. The back surface has a screen seal receiving groove therein, which is not shown but is similar to, and adequately described by, the receiving groove of the top member and side members. The receiving groove has a lip for retaining a screen seal, also not shown, but similar to, and adequately described by, the receiving groove of the top member and side members.

Each side member has a generally rectilinear configuration with a generally flat front surface 118 and a generally flat back surface 120. Each side member back surface has a screen seal receiving groove 122 therein. The receiving groove has a lip 124 for retaining a screen seal 126. Each side member has a pivot pin hole located therein, corresponding with the pivot pin hole in the passageway frame, side members, which allows the door frame to swing in a horizontal orientation, as shown in FIG. 3, as opposed to a vertical orientation, as found in a screen door.

There is a locking latch 130 having a first end 132 and a second end 134. There is a fastening hole 136 located on the first end of the locking latch. The fastening hole has an associated fastener, which may be a pin 138, rivet, or screw. The locking latch has a generally rectilinear configuration with a notched slot 140 therein. The notched slot has an associated pin hole 142. The locking latch has an associated fastener and an associated pin 144.

There is a flexible seal strip 146 which has a generally rectilinear configuration. The flexible seal strip is attached to the front surface of the bottom member.

The locking latch is used for keeping the door frame in an open orientation. The locking latch is coupled to the passageway frame and passageway door frame. The pin forms a fastener affixes a first end of the locking latch and the pin is attached to the door frame and provides a point of engagement for the notched slot, allowing the door to be kept open to varying degrees.

In a variation of the preferred embodiment, the door frame has a spring biased 147 bolt 148 housed therein. The bolt engages a hole 149 in each of the side members of the passageway frame, thereby allowing the gate to be secured in the closed, or shut, position.

Installation may be carried out with the use of an installation kit 150, having a set of instructions 152, a seal installer 154 which is well known in the art, and a length of seal 156, which is also well known in the art, as shown in FIG. 9.

The installation is carried out by locating the area where water accumulates on the patio or deck surface. The bird cage structure usually has a base member 160 which attaches the bird cage to the patio deck. The base member length which allows the installation of the passageway is then marked, and the base member is cut out. The screen is left intact and trimmed from the base member. The passageway is attached to the structure member using the long strip and the short strip. The screening is then coupled to the passageway frame by forcing the seal into the receiving groove of the passageway frame, affixing the screen to the passageway frame. The screening is then trimmed, allowing for the passageway door frame to swing through the extent of the travel allowed by the notched latch. If the door frame is not screened, then an amount of screen sufficient to cover the opening in the door frame is placed over the door frame, and then fixed in place by pressing the seal into the receiving groove, fixing the screening to the door frame.

The advantage of the presently disclosed device is that it allows the user to place the water passageway where he or she needs to direct the water flow. The two directional opening accommodates vegetation and plants, or structures. This allows the passageway door frame to swing "out" or "in", as well as latching it open, so as to allow water to be pushed out of the patio area. Unlike dog doors, commonly placed in screen enclosures, this device allow for water to exit the area by removing the bottom component of the common dog door, and providing for an adjustable seal mounting to make for a tight as possible seal against bugs and dirt.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A screened area water passageway comprising, in combination:

a passageway frame having a front surface and a back surface and a top member and a pair of generally parallel side members, with the passageway frame having an open bottom the passageway frame top member having a flat front surface and flat top surface and a generally flat back surface, each of the passageway frame side members having a front flat surface and a flat back surface, with each of the inner surfaces of each of the passageway side members having a pivot pin hole therein, with each side member having an associated pivot pin;

a long side mounting strip having a first length, the long side mounting strip being coupled to the passageway frame, the long side mounting strip having a generally h-shaped configuration;

a short side mounting strip and having a second length, the short side mounting strip having a generally h-shaped configuration;

a passageway door frame having a top member and a bottom member and a pair of generally parallel like-configured side members, the passageway door frame being coupled to the passageway frame, the passageway door frame bottom member and passageway door frame top member each having a generally flat front surface and a generally flat upper surface and generally flat lower surface and a generally flat back surface with the back surface of each having a screen seal receiving groove therein, the passageway door frame side members each having a generally flat front surface and a generally flat back surface and generally flat inner surface and a generally flat outer surface, with the back surface of each of the passageway door frame side members having a screen seal receiving groove therein, the passageway door frame top member back surface having a screen seal receiving groove therein, the back surface of each of the passageway door frame side members having a screen seal receiving groove therein, the back surface of the passageway door frame bottom member having a screen seal receiving groove therein, each passageway door frame side member having a generally flat inner surface with the inner surface having a side brush groove therein, the passageway door frame top member having a generally flat lower inner surface with the lower inner surface having a side brush groove therein; and a length and width of screen material sized to be received by the screen seal receiving grooves of the passageway door frame bottom member and passageway door frame top member and passageway door frame side members, the passageway door frame top member and the passageway door frame bottom member being oriented to be generally parallel.

2. The screened area water passageway as described in claim 1, with the water passageway further comprising:

the passageway frame top member brush groove being configured to mate with and receive a top brush seal, each of the passageway frame side members having a brush groove therein, the brush groove being configured to mate with and receive a side brush seal;

the long side mounting strip having a stepped back surface and a flat front surface;

the short side mounting strip having a stepped back surface and a flat front surface;

the passageway door frame top member and passageway door frame bottom member each having a generally rectilinear configuration, each passageway door frame side member having a generally rectilinear configuration, the passageway door frame top member and the passageway door frame bottom member being oriented to be generally parallel; and a flexible seal strip having a generally rectilinear configuration, the flexible seal strip being attached to the front surface of the bottom member.

3. The screened area water passageway as described in claim 2, with the water passageway further comprising:

the screen seal receiving groove of the passageway frame top member having a lip for retaining a screen seal, and screen seal receiving groove of each of the passageway frame side members having a lip for retaining a screen seal;

the long side mounting strip having at least one fastener associated there with, the short side mounting strip second length being less than the long side mounting strip first length; and the passageway door frame top member and the passageway door frame side members receiving grooves each having a lip for retaining a screen seal.

4. The screened area water passageway as described in claim 3, with the water passageway further comprising:

the passageway frame top brush seal having downwardly oriented bristles, with each passageway frame side brush seal having inwardly oriented bristles;

the long side mounting strip having at least one fastener associated there with; and the passageway door frame having a generally rectilinear configuration.

5. The screened area water passageway as described in claim 4, with the water passageway further comprising:

a deck surface;

a screen structure having a screen fastened thereto, the screen structure having at least one member;

the passageway frame being fabricated of a rigid material and having a generally rectilinear configuration, the passageway frame side members each having a generally rectilinear configuration;

the long side mounting strip being fabricated of rigid material, the long side mounting strip stepped back surface being configured to accept and mate with the structure member;

the short side mounting strip being fabricated of rigid material, the short side mounting strip stepped back surface being configured to accept and mate with the structure member;

the passageway door frame being fabricated of a rigid material; and the passageway door frame bottom member having a generally rectilinear configuration.

* * * * *